US009895888B2

(12) United States Patent
Chen et al.

(10) Patent No.: US 9,895,888 B2
(45) Date of Patent: Feb. 20, 2018

(54) FLUID FLOW STRUCTURE

(71) Applicant: HEWLETT-PACKARD DEVELOPMENT COMPANY, L.P., Houston, TX (US)

(72) Inventors: Chien-Hua Chen, Corvallis, OR (US); Michael W Cumbie, Albany, OR (US); Diane R Hammerstad, Corvallis, OR (US)

( * ) Notice: Subject to any disclaimer, the term of this patent is extended or adjusted under 35 U.S.C. 154(b) by 0 days.

(21) Appl. No.: 15/303,316

(22) PCT Filed: Apr. 22, 2014

(86) PCT No.: PCT/US2014/035037

§ 371 (c)(1),
(2) Date: Oct. 11, 2016

(87) PCT Pub. No.: WO2015/163859

PCT Pub. Date: Oct. 29, 2015

(65) Prior Publication Data

US 2017/0028725 A1 Feb. 2, 2017

(51) Int. Cl.
*B41J 2/14* (2006.01)

(52) U.S. Cl.
CPC ..... *B41J 2/1433* (2013.01); *B41J 2/1404* (2013.01); *B41J 2002/14419* (2013.01); *B41J 2202/20* (2013.01)

(58) Field of Classification Search
CPC ..... B41J 2202/20; B41J 2002/14491; B41J 2/145; B41J 2002/14419; B41J 3/543; B41J 2/135; B41J 2002/14306; B41J 2/01; B41J 2/14145; B41J 2/2135; B41J 2/5056; B41J 2/1433; B41J 2/1404
See application file for complete search history.

(56) References Cited

U.S. PATENT DOCUMENTS 6,439,699 B1 * 8/2002 Silverbrook ..... B41J 2/04528 347/42
7,850,291 B2 12/2010 Silverbrook
7,922,313 B2 4/2011 McAvoy et al.
(Continued)

FOREIGN PATENT DOCUMENTS

CN 101287606 10/2008
JP H061698875 A 7/1994
(Continued)

OTHER PUBLICATIONS

Lee, J-D. et al., A Thermal Inkjet Printhead with a Monolithically Fabricated Nozzle Plate and Self-aligned ink Feed Hole, (Research Paper), Sep. 1999. pp. 229-236.

*Primary Examiner* — Lamson Nguyen
(74) *Attorney, Agent, or Firm* — HP Inc. Patent Department

(57) ABSTRACT

In one example, a fluid flow structure includes a fluid dispensing micro device embedded in a molding having a channel therein through which fluid may flow directly to the device. The device contains multiple fluid ejectors and multiple fluid chambers each near an ejector. Each chamber has an inlet through which fluid from the channel may enter the chamber and an outlet through which fluid may be ejected from the chamber. A perimeter of the channel surrounds the inlets but is otherwise unconstrained in size by the size of the device.

11 Claims, 10 Drawing Sheets

(56) References Cited

U.S. PATENT DOCUMENTS

| | | | |
|---|---|---|---|
| 8,556,611 | B2 | 10/2013 | Dolan et al. |
| 2002/0140764 | A1 | 10/2002 | Silverbrook et al. |
| 2007/0206079 | A1 | 9/2007 | Brown et al. |
| 2008/0309697 | A1 | 12/2008 | Silverbrook |
| 2011/0037808 | A1 | 2/2011 | Ciminelli et al. |
| 2011/0228017 | A1 | 9/2011 | Dyer et al. |
| 2012/0242746 | A1 | 9/2012 | Mou et al. |
| 2013/0222493 | A1 | 8/2013 | Harvey et al. |
| 2013/0288183 | A1 | 10/2013 | Canon |
| 2013/0342607 | A1 | 12/2013 | Sung et al. |

FOREIGN PATENT DOCUMENTS

| | | | |
|---|---|---|---|
| JP | 200230118 | A | 10/2002 |
| JP | 2005-001347 | | 1/2005 |
| JP | 2013-501655 | | 1/2013 |
| JP | 2013-230659 | | 11/2013 |
| WO | WO2009067730 | | 6/2009 |
| WO | WO-2010044775 | | 4/2010 |
| WO | WO 2012054050 | | 4/2012 |
| WO | WO-2014133561 | | 9/2014 |
| WO | WO-2014133660 | | 9/2014 |

* cited by examiner

FLUID FLOW STRUCTURE

BACKGROUND

Each printhead die in an inkjet pen or print bar includes tiny passages that carry ink or other printing fluid to the ejection chambers. Printing fluid is distributed to the die passages through channels in a structure that supports the printhead dies on the pen or print bar. It may be desirable to shrink the size of each printhead die, for example to reduce the cost of the die and, accordingly, to reduce the cost of the pen or print bar.

DRAWINGS

The same part numbers designate the same or similar parts throughout the figures. The figures are not necessarily to scale. The size of some parts is exaggerated to more clearly illustrate the example shown.

DESCRIPTION

Conventional inkjet printer pens and print bars include multiple parts that carry printing fluid to small printhead dies from which the printing fluid is ejected on to paper or other print media. The printhead dies are usually assembled to the supporting structure with adhesives. Adhesive based assembly processes become increasingly complex and difficult as the printhead dies get smaller. A new fluid flow structure without adhesives has been developed to enable the use of smaller printhead dies to help reduce the cost of pens and print bars in inkjet printers.

In one example, the support structure is molded around the printhead die or other fluid dispensing micro device. The molding itself supports the device. Thus, the micro device is embedded in the molding without adhesives. The molding includes a channel through which fluid may flow directly to the micro device. The micro device contains multiple fluid ejectors and multiple fluid chambers each near an ejector and each with an inlet through which fluid from the channel may enter the chamber and an outlet through which fluid may be ejected from the chamber. A perimeter of the channel in the molding surrounds the inlets to the ejection chambers but is otherwise unconstrained in size by the size of the micro device. Consequently, where the micro device is a printhead die, the channel may be nearly as broad as or even broader than the die, which is not feasible in conventional adhesive based printhead fabrication. Broader fluid channels enable higher ink flux in the printhead die while reducing the risk of air bubbles blocking ink flow through the channel. Also, the molding in effect grows the size of each printhead die for making external ink connections and for attaching the dies to a pen or print bar, eliminating the need to form the ink channels in a silicon substrate and enabling the use of thinner, longer and narrower dies.

These and other examples shown in the figures and described below illustrate but do not limit the disclosure, which is defined in the Claims following this Description.

As used in this document, a "micro device" means a device having one or more exterior dimensions less than or equal to 30 mm; "thin" means a thickness less than or equal to 650 μm; a "sliver" means a thin micro device having a ratio of length to width (L/W) of at least three; a "printhead" and a "printhead die" mean that part of an inkjet printer or other inkjet type dispenser that dispenses fluid from one or more openings. A printhead includes one or more printhead dies. "Printhead" and "printhead die" are not limited to printing with ink and other printing fluids but also include inkjet type dispensing of other fluids and/or for uses other than printing.

Figure 1:
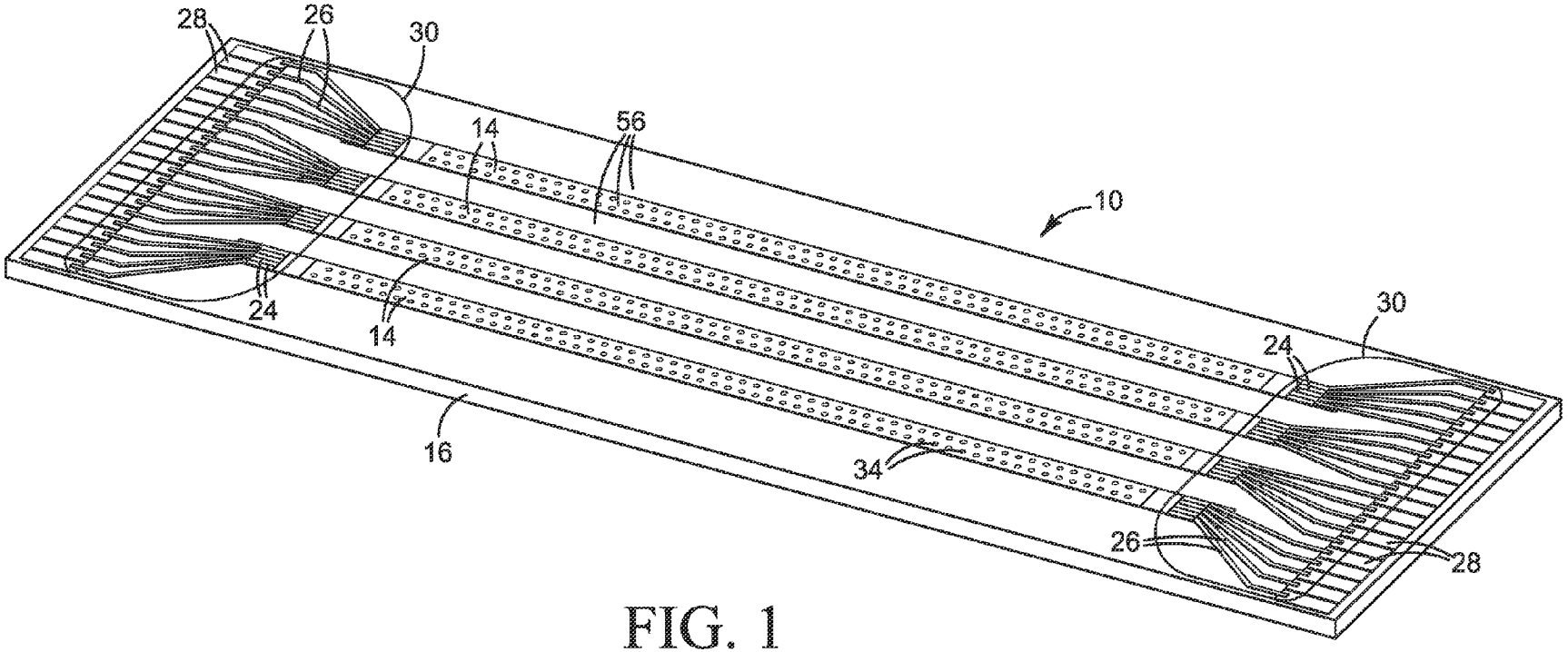
FIGS. 1 and 2 are front and back views, respectively, illustrating an inkjet printhead implementing one example of a molded fluid flow structure.
Figure 2:
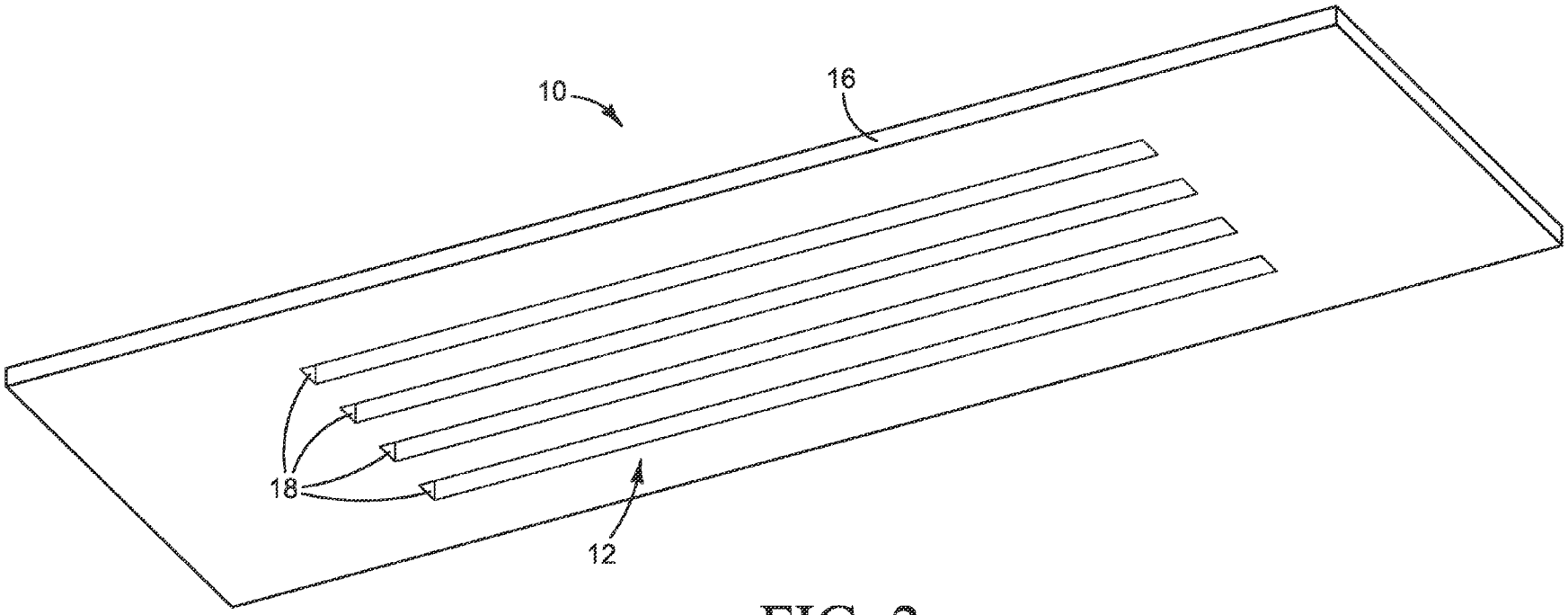
Figure 3:
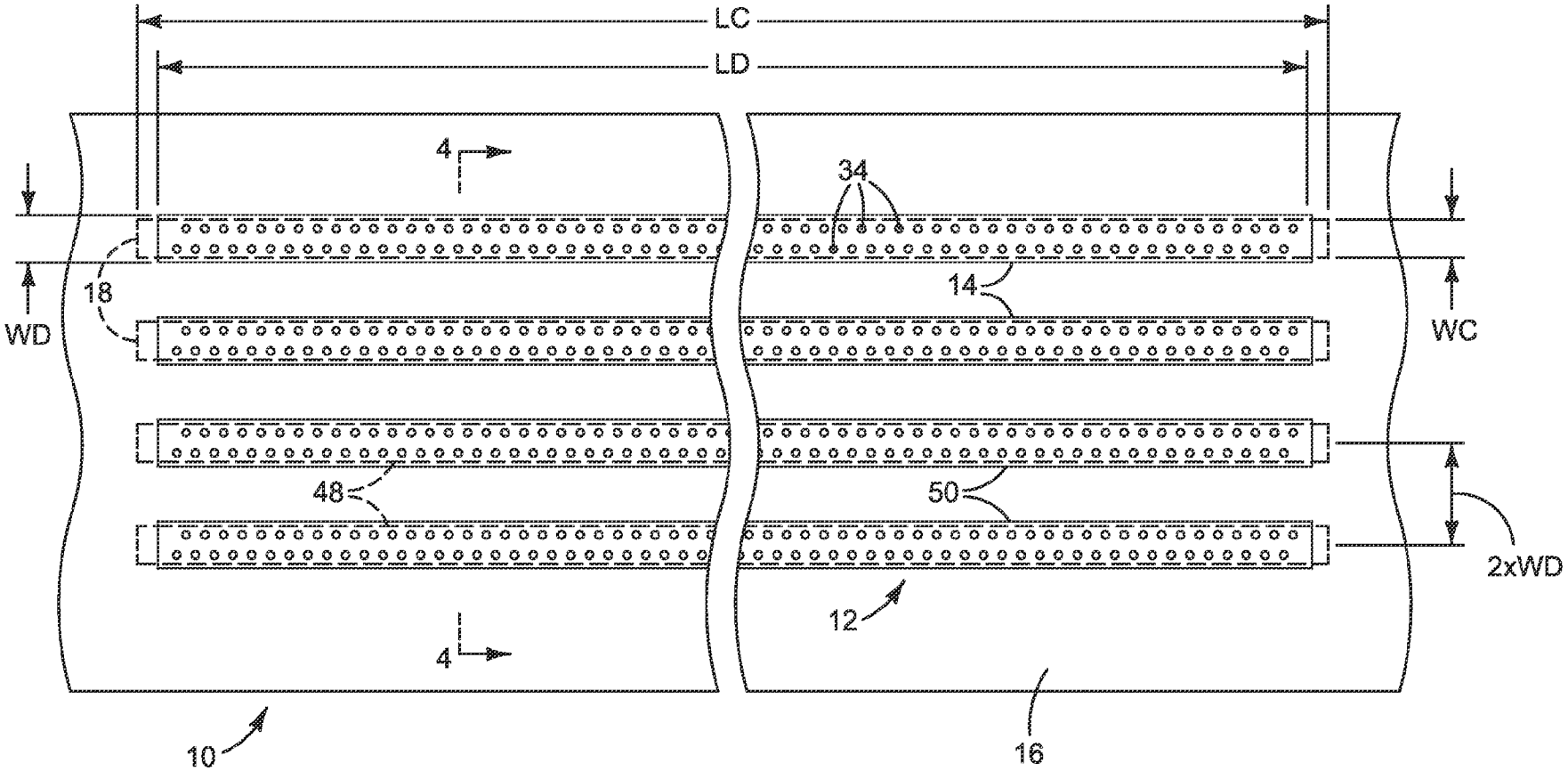
FIG. 3 is a partial front side plan view of the printhead shown in FIGS. 1 and 2.
Figure 4:
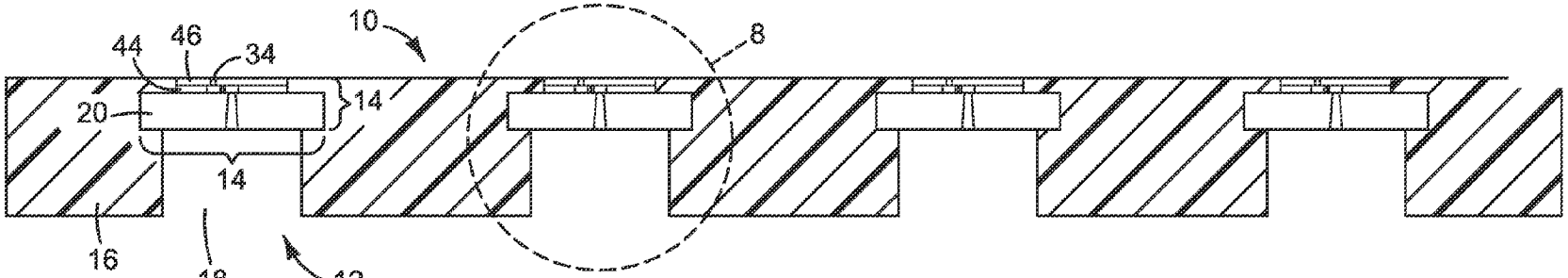
FIG. 4 is a section taken along the line 4-4 in FIG. 3.
Figure 5:
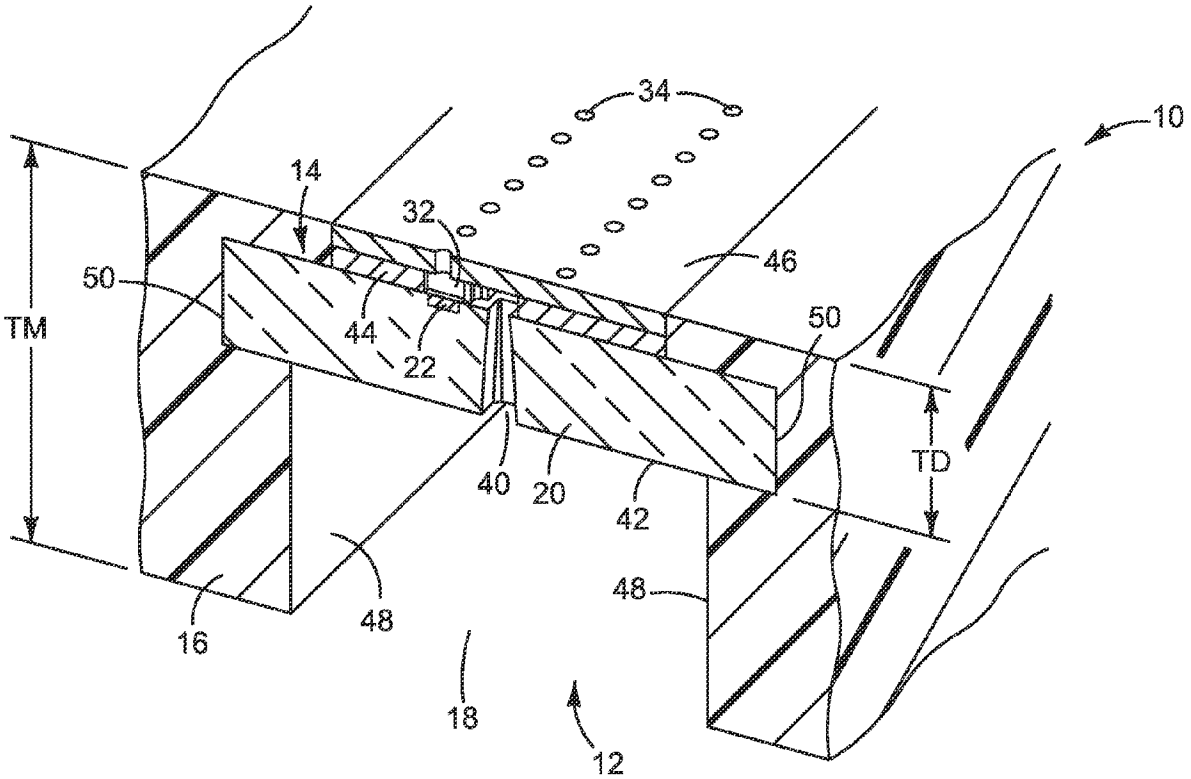
FIGS. 5-8 illustrate details from FIGS. 3 and 4.
Figure 6:
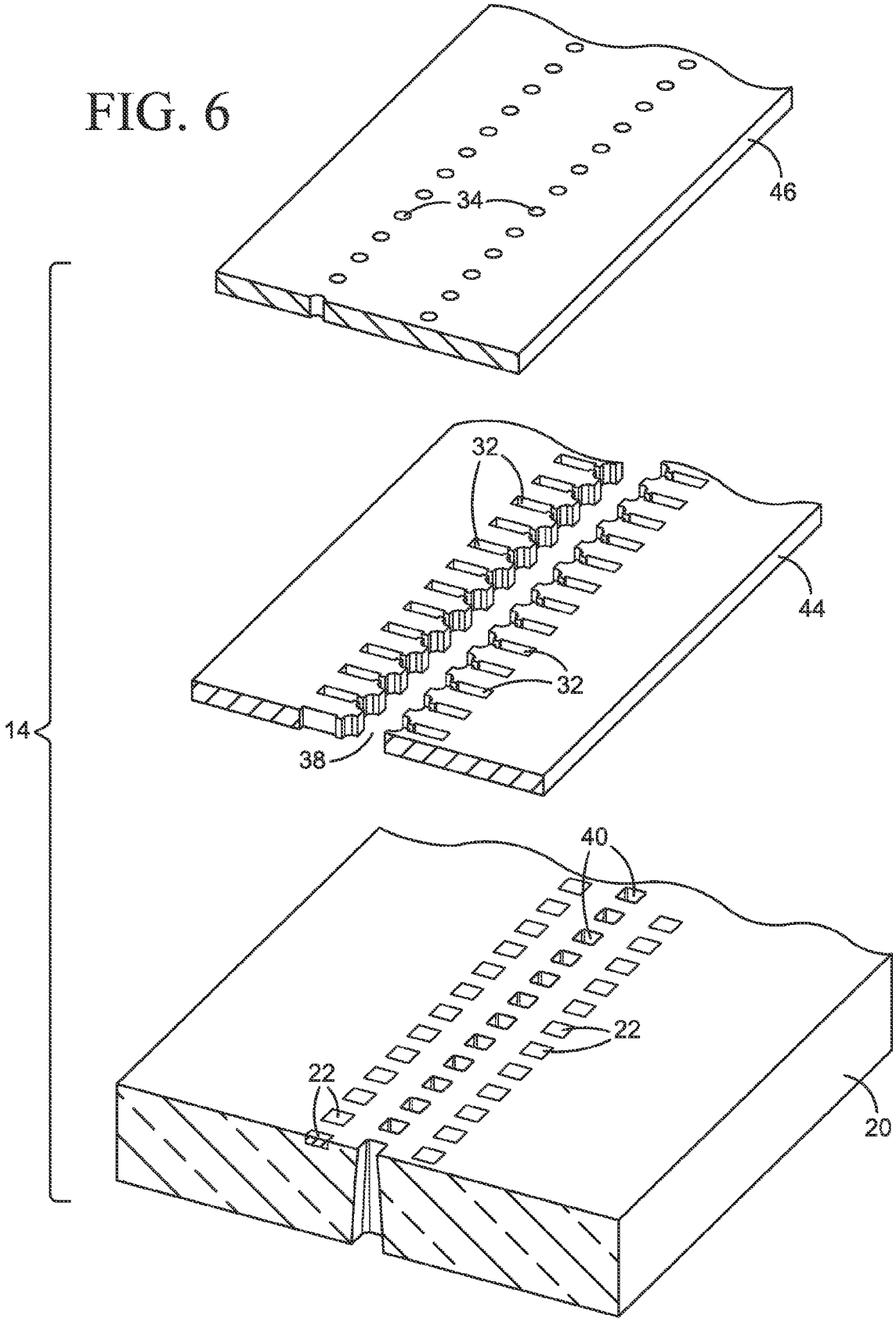
Figure 7:
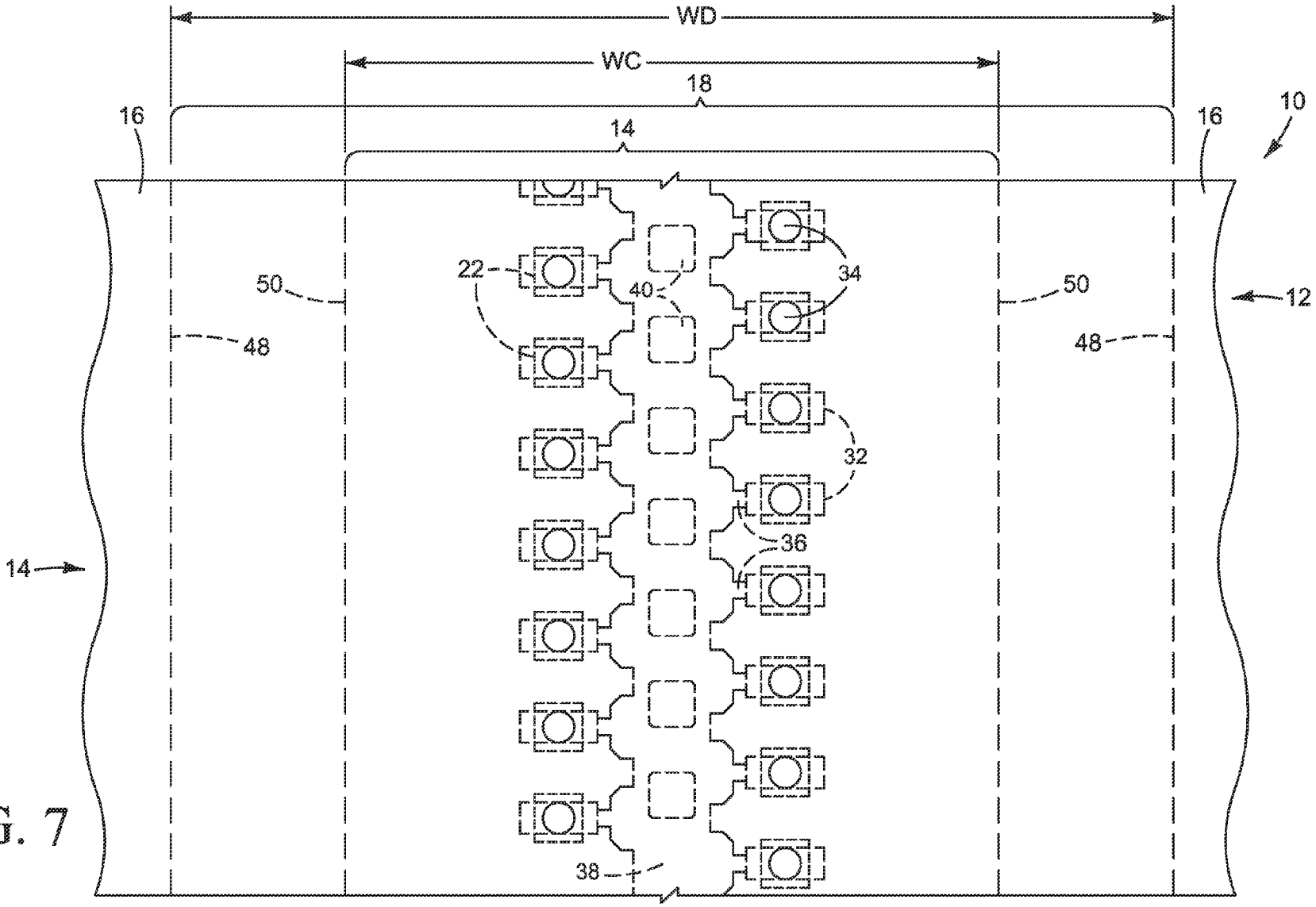

FIGS. 1 and 2 are front and back views, respectively, illustrating an inkjet printhead 10 implementing one example of a molded fluid flow structure 12. FIG. 3 is a partial front side plan view of the printhead 10 shown in FIGS. 1 and 2. FIG. 4 is a section view taken along the line 4-4 in FIG. 3. FIGS. 5-8 are detail views from FIGS. 3 and 4. Referring to FIGS. 1-8, printhead 10 includes multiple printhead dies 14 molded into or otherwise embedded in a molding 16 without an adhesive. Channels 18 are formed in molding 16 to carry printing fluid directly to corresponding printhead dies 14. (Cross hatching is omitted from dies 14 in the section view of FIG. 4 for clarity.) In the example shown, each printhead die 14 is configured as a die sliver. Die slivers 14 are arranged parallel to one another across the width of printhead 10. Although four die slivers 14 are shown in a parallel configuration, more or fewer dies or die slivers may be used and/or in a different configuration.

An inkjet printhead die 14 is a typically complex integrated circuit (IC) structure formed on a silicon substrate 20. Thermal, piezoelectric or other suitable fluid ejector elements 22 and other components (not shown) in each printhead IC circuit structure are connected to external circuits through bond pads or other suitable electrical terminals 24 on each die 14. In the example shown, conductors 26 connect terminals 24 to contacts 28 for connection to external circuits. Conductors 26 may be covered by an epoxy or other suitable protective material 30 as necessary or desirable to protect the conductors from ink and other potentially damaging environmental conditions. Only the outline of protective material cover 30 is shown in FIG. 1 to not obscure the underlying structures.

Referring now specifically to the detail views of FIGS. 5-8, in the example shown each printhead die 14 includes two rows of ejection chambers 32 and corresponding nozzles 34 through which ink or other printing fluid is ejected from chambers 32. Each channel 18 in molding 16 supplies printing fluid to one printhead die 14. Other suitable configurations for printhead dies 14 and channels 18 are possible. For example, more or fewer ejection chambers 32 and/or channels 18 could be used. Printing fluid flows into each ejection chamber 32 through an inlet 36 from a manifold 38 extending lengthwise along each die 14 between the two rows of ejection chambers 32. Printing fluid feeds into manifold 38 through multiple ports 40 that are connected to a printing fluid supply channel 18 at die surface 42. The idealized representation of a printhead die 14 in FIGS. 5-8 depicts three layers (substrate 20, chamber layer 44, and nozzle plate 46) for convenience only to clearly show ejection chambers 32, nozzles 34, inlets 36, manifold 38, and ports 40. An actual inkjet printhead die 14 may include fewer or more layers than those shown and/or different paths for supplying fluid to chambers 32. For example, a single passage may be used in place of multiple ports 40 with or without a manifold 38.

Molding 16 eliminates the need for an adhesive to assemble printhead dies 14 to an underlying support and/or fan-out structure, leaving the size of each channel 18 unconstrained by the size of the corresponding die 14. Thus it is possible to make channels 18 broader or narrower than dies 14 as necessary or desirable to accommodate ever smaller dies. In the example shown in FIGS. 3-8, each channel 18 is narrower than the corresponding die 14. Channel 18 surrounds nozzles 34 with a width WC less than the width WD of printhead die 14. Accordingly, the planar area AC of channel 18 (WC×LC) is less than the planar area AD of die 14 (WD×LD). For a conventional printhead in which the die is assembled to the underlying support and/or fan-out structure with adhesive, the edges of the ink supply channel must overlap the printhead die by 200 μm or more so that the adhesive does not protrude into the channel during assembly. For a molded printhead 10 shown in FIGS. 3-8, the lengthwise edges 48 of channel 18 may be within 200 μm of the lengthwise edges 50 of printhead die 14 (WD−WC<400 μm).

Figure 9:
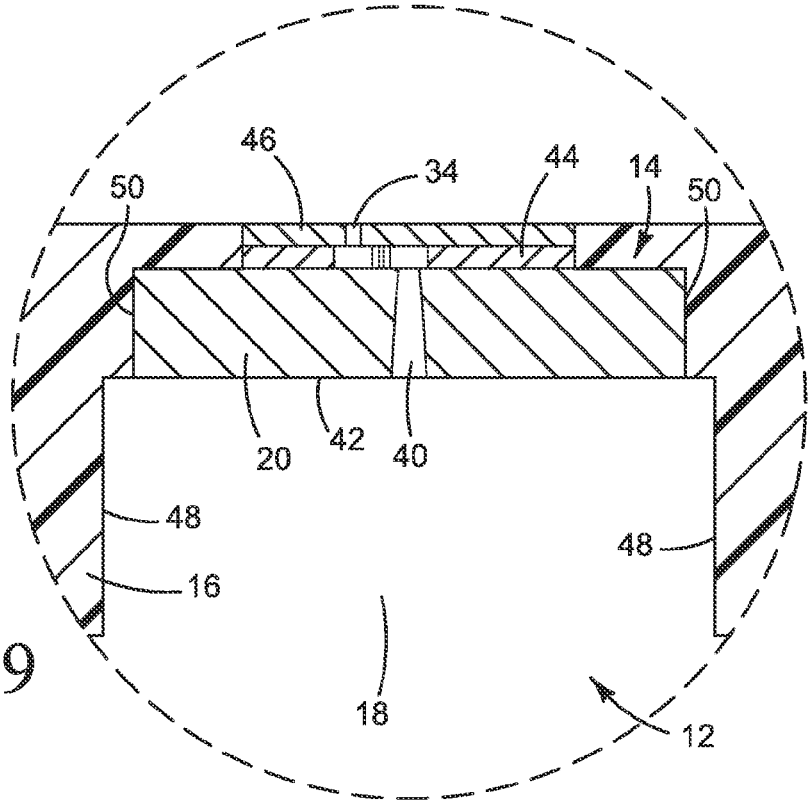
FIG. 9 illustrates another example of a printhead molded fluid flow structure.

In the example shown in FIG. 9, channel 18 surrounds nozzles 34 and is broader than printhead die 14. Accordingly, the planar area of channel 18 in the configuration shown in FIG. 9 is greater than the planar area of die 14.

While the relative size of each channel 18 and corresponding die 14 may vary depending on the particular fluid flow implementation, it is expected that for a typical inkjet printhead 10 using thin die slivers 14 the ratio of die area AD to channel area AC will usually be in the range of 2.0 to 0.25 (2.0≥AD/AC≥0.25). Presently, this range of area ratios is not feasible with adhesive based die attach techniques. The use of a molded printhead 10 enables this expanded range of channel and die size ratios.

Figure 8:
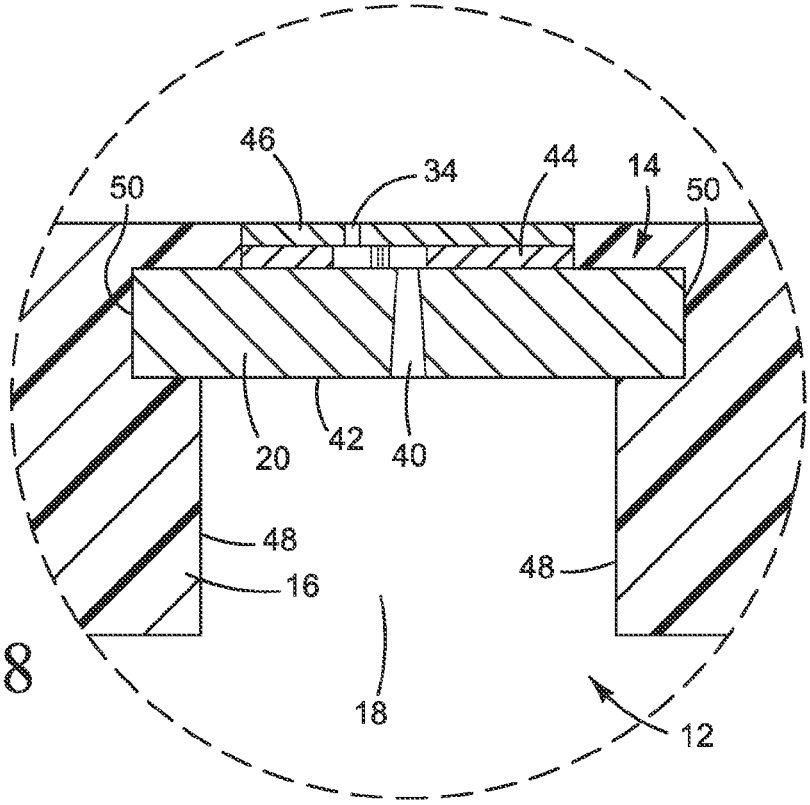

As best seen in FIGS. 8 and 9, printing fluid supply channels 18 are substantially broader than printing fluid ports 40 to carry printing fluid from larger, loosely spaced passages in the pen or print bar to the smaller, tightly spaced printing fluid ports 40 in printhead dies 14. Not only do larger channels 18 ensure an adequate supply of printing fluid to dies 14, the larger channels 18 can help reduce or even eliminate the need for a discrete "fan-out" fluid routing structure necessary in many conventional printheads. In addition, exposing a substantial area of printhead die surface 42 directly to channel 18, as shown, allows printing fluid in channels 18 to help cool dies 18 during printing.

For implementations with thin die slivers 14, it is expected that a molding 16 thickness TM (FIG. 5) at least twice the die 14 thickness TD will be desirable for adequate support. Channels 18 may be cut, etched, molded or otherwise formed in molding 16. Also, the size of each channel 18 may be varied as necessary or desirable for the corresponding printhead die 14.

Figure 10:
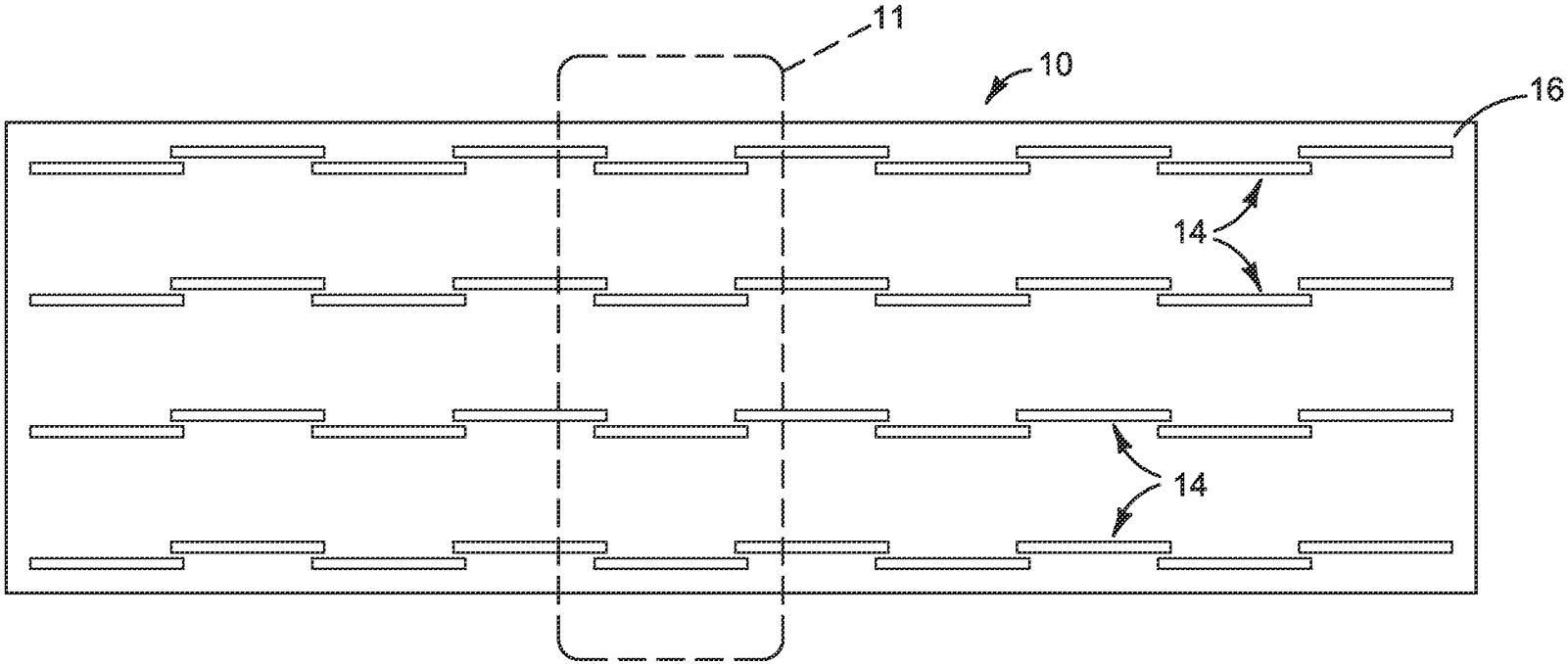
FIG. 10 illustrates an inkjet printhead implementing another example of a molded fluid flow structure.
Figure 11:
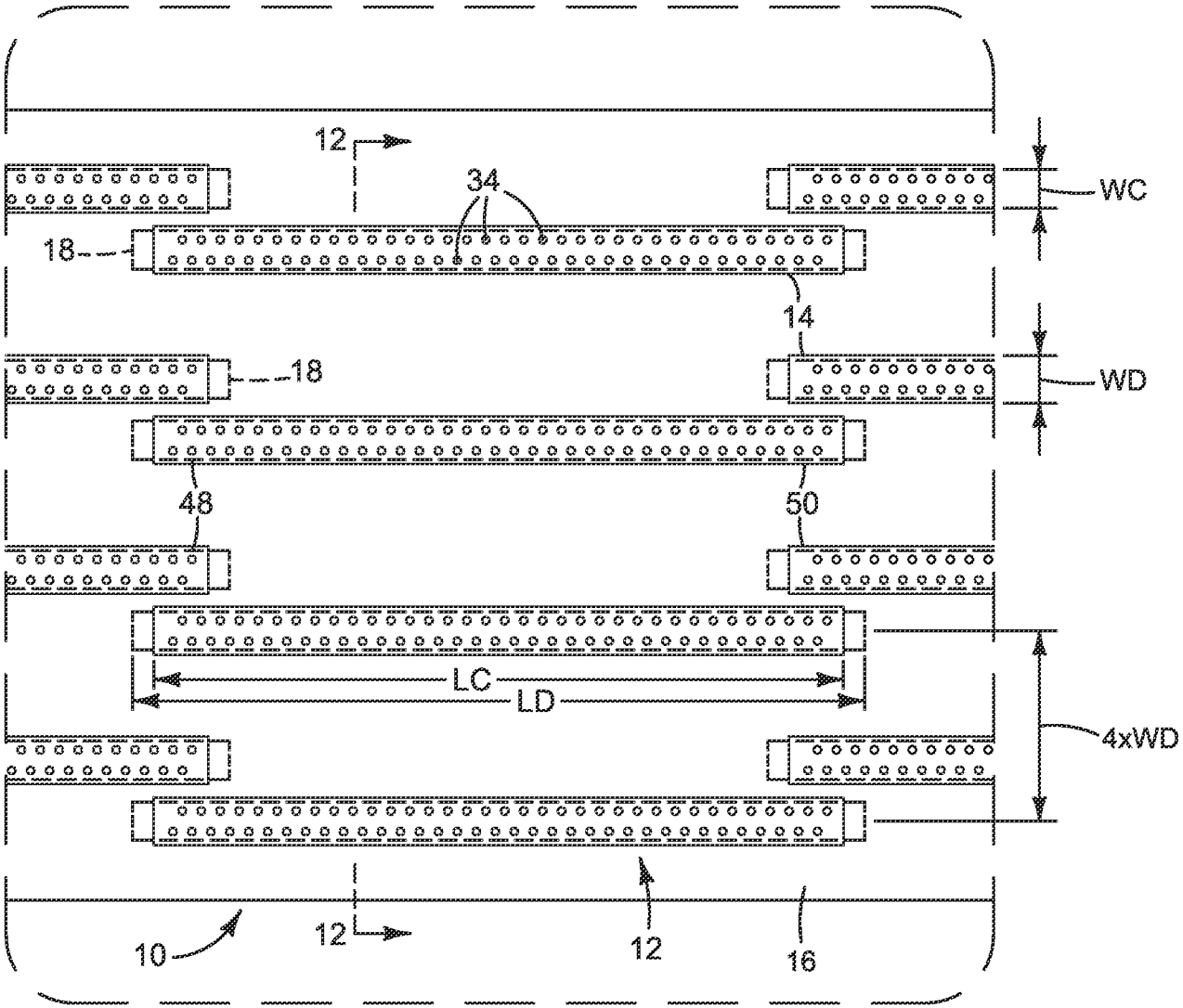
FIG. 11 is a detail from FIG. 10.
Figure 12:
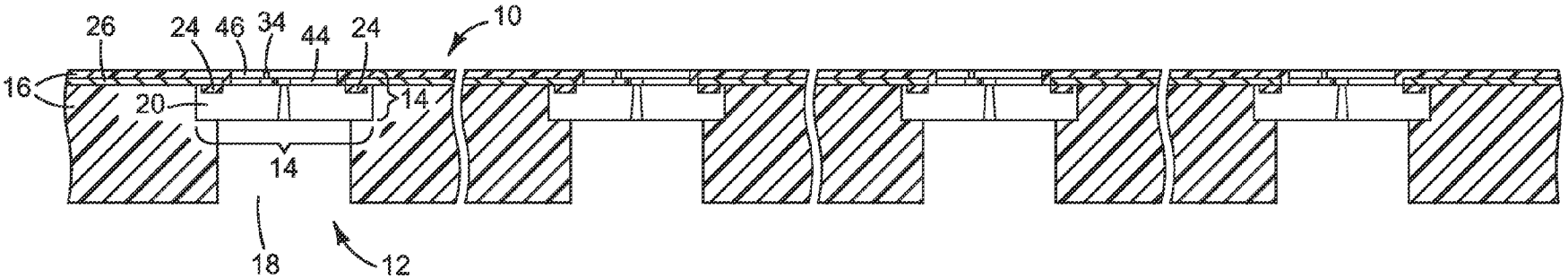
FIG. 12 is a section taken along the line 12-12 in FIG. 11.

FIG. 10 illustrates another example of a printhead 10 implementing a molded fluid flow structure 12. FIG. 11 is a detail from FIG. 10. FIG. 12 is a section taken along the line 12-12 in FIG. 11. In this example, four rows of die slivers 14 are arranged generally end to end in a staggered configuration in which each die sliver overlaps another die sliver, such as might be used in a page wide print bar dispensing four colors of ink. Other suitable configurations are possible. Printhead dies 14 larger than slivers could be used, with more or fewer dies and/or in a different configuration.

Referring to FIGS. 10-12, printhead 10 includes printhead die slivers 14 molded into a molding 16. Channels 18 are formed in molding 16 to carry printing fluid directly to corresponding die slivers 14. Each channel 18 surrounds nozzles 34 on the corresponding die sliver 14. In this example, each channel 18 is narrower than the corresponding die sliver 14. As noted above, however, the width of each channel 18 relative to the corresponding die sliver 14 may vary from that shown, including widths broader than die sliver 14. Fluid ejector elements and other components in each printhead IC circuit structure are connected to external circuits through bond pads or other suitable electrical terminals 24 on each die 14. In this example, conductors 26 connecting terminals 24 to other dies and/or to external circuits are embedded in molding 16.

Molded printhead flow structures like those shown in the figures and described above uncouple continued die shrink from adhesive allowances and from the difficulties of forming ink supply channels in a silicon substrate, simplifying the assembly process, expanding design flexibility and enabling the use of long, narrow and very thin printhead dies. Any suitable molding process may be used including, for example, a transfer molding process such as that that described in international patent application no. PCT/US2013/052505 filed Jul. 29, 2013 titled Transfer Molded Fluid Flow Structure or compression molding such as that described in international patent application PCT/US2013/052512 filed Jul. 29, 2013 titled Fluid Structure With Compression Molded Channel.

As noted at the beginning of this Description, the examples shown in the figures and described above illustrate but do not limit the disclosure. Other examples are possible. Therefore, the foregoing description should not be construed to limit the scope of the disclosure, which is defined in the following claims.

What is claimed is:

1. A fluid flow structure, comprising a fluid dispensing micro device embedded in a molding having a channel therein through which fluid may flow directly to the device, the device containing multiple fluid ejectors and multiple fluid chambers each near an ejector and each chamber having an inlet through which fluid from the channel may enter the chamber and an outlet through which fluid may be ejected from the chamber, a perimeter of the channel surrounding the inlets, wherein:

an area of the channel is 0.25 to 2 times an area of the device, the device comprises an elongated device having a length and a width, the area of the device being the product of its length and width;

the channel comprises an elongated channel extending along the device, the channel having a length and a width, the area of the channel being a product of its length and width and the width of the channel being less than the width of the device; and each lengthwise edge of the channel within 200 μm of a lengthwise edge of the device.

2. The structure of claim 1, wherein the channel is narrower than the device.

3. The structure of claim 1, wherein the channel is broader than the device.

4. The structure of claim 1, wherein a thickness of the device is less than one-half a thickness of the molding.

5. The structure of claim 4, wherein the device also contains within its thickness:

multiple ports connected to the channel such that fluid can flow from the channel directly into the ports; and a manifold connected between the ports and the inlets such that fluid can flow from the ports into the manifold to the inlets.

6. The structure of claim 5, wherein the fluid dispensing device comprises a printhead die and the printhead die is embedded in a monolithic molding.

7. A printhead, comprising:

a molding having multiple elongated channels therein each having a length and a width and an area being a product of the length and width;

multiple elongated printhead dies each having a length and a width and an area being a product of the length and width, each die molded into the molding and connected to the channels so that printing fluid may pass from each channel to a corresponding one of the dies; and the area of each channel being 0.25 to 2 times the area of the corresponding die.

8. The printhead of claim 7, wherein each die comprises a die sliver and the die slivers are molded into a monolithic molding and arranged parallel to one another across a width of the printhead.

9. The printhead of claim 7, wherein each die comprises a die sliver and the die slivers are molded into a monolithic molding and arranged generally end to end along a length of the printhead in a staggered configuration in which each die overlaps another die.

10. The printhead of claim 7, wherein:

each die comprises a die sliver;

each channel is narrower than the corresponding die sliver; and each lengthwise edge of each channel is within 200 μm of a lengthwise edge of the corresponding die sliver.

11. The printhead of claim 7, wherein each die comprises a die sliver and each channel is broader than the corresponding die sliver.

* * * * *